US011732386B2

(12) United States Patent
Dilo

(10) Patent No.: US 11,732,386 B2
(45) Date of Patent: Aug. 22, 2023

(54) FEED DEVICE OF A FLEECE-FORMING MACHINE

(71) Applicant: Oskar Dilo Maschinenfabrik KG, Eberbach (DE)

(72) Inventor: Johann Philipp Dilo, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 455 days.

(21) Appl. No.: 16/863,704

(22) Filed: Apr. 30, 2020

(65) Prior Publication Data

US 2020/0362478 A1 Nov. 19, 2020

(30) Foreign Application Priority Data

May 16, 2019 (EP) ..... 19 174 837.5

(51) Int. Cl.
*D01G 23/04* (2006.01)
*D04H 1/736* (2012.01)

(52) U.S. Cl.
CPC ..... *D01G 23/04* (2013.01); *D04H 1/736* (2013.01)

(58) Field of Classification Search
CPC combination set(s) only.
See application file for complete search history.

(56) References Cited

U.S. PATENT DOCUMENTS 6,173,478 B1 * 1/2001 Patelli ..... D01G 23/04 19/105
9,187,852 B2 * 11/2015 Dilo ..... D01G 23/04
2006/0048342 A1 3/2006 Rubenach

FOREIGN PATENT DOCUMENTS

EP 2 695 976 A1 2/2014
EP 2 695 980 A1 2/2014

OTHER PUBLICATIONS

EP 19 17 4837.5 Search Report dated Nov. 11, 2019.

* cited by examiner

*Primary Examiner* — Lynda Salvatore
(74) *Attorney, Agent, or Firm* — Jansson Munger McKinley & Kirby Ltd.

(57) ABSTRACT

The feed device for delivering individualized fibers to a transport device comprises a feed roller, which is configured to draw in a plurality of strands of starting material arranged adjacent to each other, and an opening roller, which cooperates with the feed roller to open the strands of starting material. The feed device also comprises a plurality of metering devices assigned to the feed roller, wherein each metering device is configured to regulate the delivery of at least one strand of starting material to the feed roller.

9 Claims, 5 Drawing Sheets

FEED DEVICE OF A FLEECE-FORMING MACHINE

FIELD OF THE INVENTION

The present invention relates to a feed device for feeding individualized fibers to a transport device, to a fleece-forming machine comprising such a feed device, and to a method for forming or profiling a web of material.

In the production of nonwoven fabric or fleece, fiber flocks are usually discharged from a flock feeder to a transport device, which carries them onward in the form of a flock mat to a web-forming device such as a carding machine or a fleece-forming machine, or to a solidification machine such as a needling machine. It is usually desirable for a nonwoven fabric to be produced with a very high degree of uniformity. For this purpose, appropriate intervention is present at various locations in the system. For example, the weight of the flock mat can be measured by a belt weigher, and on this basis the feed rate to the web former can be adjusted. As an alternative to a highly uniform fleece, it is also desirable in many applications to form a fleece with a surface profile.

A feed device for delivering individualized fibers or fiber flocks to a transport device is known from U.S. Pat. No. 9,187,852 B2. This feed device comprises a plurality of feed segments arranged horizontally next to each other and transversely to the transport direction. Each of these feed segments has its own feed roller, which cooperates with an opening roller of the feed device to open a starting material such as a fiber sliver or a strip of fiber fleece. This makes it possible to effectively set and vary the quantity of fibers or flocks dispensed by the feed device transversely to the transport direction of the transport device and thus to compensate for defective areas or irregularities in the flock mat or fleece web or to produce a predetermined transverse profile.

Each feed segment is supplied with its own strand of starting material, which is fed to the middle of the feed segment, i.e., centrally relative to the width of its feed roller. This has the result that, at certain times, the individualized fibers or flocks are not distributed completely uniformly across the width of the feed segment in question and are thus discharged nonuniformly onto the transport device, wherein more fibers or flocks are discharged from the middle than from the edges of the feed segment.

Because each feed segment has its own feed roller, which therefore must be supported rotatably and driven individually, an appropriate amount of space must be provided between the feed rollers of adjacent feed segments, which means that it is usually impossible to arrange the feed rollers directly adjacent to each other in the axial direction. As a result, there can be areas extending transversely to the transport direction of the transport device and thus of the material web to be formed at which no fibers or flocks are discharged by the feed device. This leads to a loss of strength of the material web in the transverse direction, and it is impossible reliably to correct all the defective areas or irregularities.

At certain times it is therefore difficult to produce a material web such as a flock web, a card web, or a fleece web with the desired uniformity transversely to the transport direction or to produce a desired transverse profile with the desired degree of resolution. Providing bearing points and drives for each of the plurality of feed rollers, furthermore, leads to a feed device with a complicated engineering design and also to high costs.

SUMMARY OF THE INVENTION

It is an object of the present invention to provide a feed device, a fleece-forming machine, and a method for feeding individualized fibers to a transport device which make it possible to achieve the finest possible resolution of the fiber distribution transversely to the transport direction and which leads to a less complicated, lower-cost design of the feed device.

According to an aspect of the invention, a feed device for feeding individualized fibers to a transport device comprises a feed roller, which is configured to draw into the feed device a plurality of strands of fiber starting material arranged next to each other in an axial direction of the feed roller, and an opening roller, which cooperates with the feed roller to open the strands of starting material. The feed device also comprises a plurality of metering devices assigned to the feed roller, wherein each metering device of the plurality of metering devices is configured to regulate the feed of at least one strand of starting material to the feed roller.

It is thus possible to regulate the feed of a strand of starting material and thus the quantity of fibers produced from it and discharged onto the transport device without the need to provide multiple feed rollers which much be individually supported and individually actuated for this purpose. Instead, a plurality of strands can be drawn in by the same feed roller, wherein the possibility of varying the distribution of fiber quantities transversely to the transport direction of the transport device (also called the "transverse direction" in the following) nevertheless remains available. As a result, bearing points for feed rollers between adjacent strands of starting material are eliminated, which means that the fibers are discharged more uniformly onto the transport device and/or a higher resolution of fiber distribution onto the transport device is achieved. Because of the decrease in the number of defective areas and in the number of individually actuatable feed rollers and corresponding drives, furthermore, the costs of the feed device are significantly reduced.

The feed roller preferably draws in at least two, preferably at least three, at least five, at least ten, or at least twenty adjacent strands of the fiber starting material into the feed device. Correspondingly, it is preferred that the feed device comprise at least two, preferably at least three, at least five, at least ten, or at least twenty adjacent metering devices, which are distributed over the working width of the feed device. The working width of the feed device corresponds to the maximum width of the material web to be formed or profiled and is usually in the range between 0.5 m and 6 m.

Each strand of the starting material can be formed by, for example, a fiber sliver, a yarn, or a strip of fiber fleece. The strand can be partially or completely opened by the cooperation between the feed roller and the opening roller, so that either fiber flocks or individual fibers are obtained, both of which are referred to here as "opened fibers".

To open the starting material, the feed roller and the opening roller operate together in the area where they face each other. The starting material is drawn in between the feed roller in question and the opening roller and is opened there, i.e., separated into its individual components such as individual fibers or flocks. For this purpose the feed roller and the opening roller usually comprise sets of teeth, which engage in the starting material and pull it apart to produce separate fibers or flocks from the starting material. The feed and/or opening roller, however, can also have a rubberized surface and can grip the starting material by friction. The cooperation between the feed roller and the opening roller and their preferred embodiments are familiar to the skilled person. An axial direction of the feed roller is preferably parallel to an axial direction of the opening roller and transverse to the transport direction.

Depending on the desired purpose and arrangement of the feed device in the fleece-forming process, the feed device can, by feeding the opened fibers to the transport device, form a new material web on the transport device or feed opened fibers to an existing material web being conveyed on the transport device under and along the feed device. To cover the various possibilities in general, a "material web" is discussed in the following, which, for example, can be a flock mat, a card web, or a fleece web. The material web is arranged on a substantially flat surface of the transport device. The axial direction of the feed roller and of the opening roller is preferably parallel to this flat surface and thus to the material web.

As previously explained, each of the plurality of metering devices is configured to regulate the feed of at least one strand of the starting material to the feed roller. This means that the metering device can change the amount of starting material being supplied per unit time or per rotation of the feed roller by, for example, inhibiting the feed, i.e., slowing it down, or by stopping it completely. Each metering device can also regulate the amount of starting material being supplied per unit length by, for example, stretching the strand of the starting material in question.

So that the feed of at least one strand of starting material can be regulated, each metering device can be arranged relative to the strand in such a way that it influences the feed roller's action on the strand, so as in particular to inhibit or to stop the strand from being drawn in.

It is preferred that at least one first metering device of the plurality of metering devices be actuatable independently of at least one second metering device of the plurality of metering devices. It is even more preferable for each metering device of the plurality of metering devices to be actuatable independently of all of the other metering devices.

Because the metering devices are arranged next to each other in an axial direction of the feed roller and because each one is configured to regulate the feed of at least one strand of starting material to the feed roller independently of the other strands of starting material, the delivery of fibers onto the transport device in the transverse direction can be adjusted in an especially precise manner and with great flexibility.

It can also be desirable, however, to actuate some of the metering devices of the plurality of metering devices jointly or to actuate all of them jointly, e.g., in order to create a new material web of highly uniform thickness on the transport device.

The opening roller is driven by, for example, a servo motor. The opening roller is preferably configured to be continuous in the direction transverse to the transport direction, but it can also be formed by several opening roller sections axially adjacent to each other. The provision of an opening roller which is continuous transversely to the transport direction leads to an especially simple and low-cost construction.

In a preferred embodiment, the feed roller extends continuously over the entire working width of the feed device. This means that the feed device comprises only a single feed roller, as a result of which the number of bearing points and drives is minimized. The feed device is then in this respect configured with the greatest possible simplicity and the lowest possible cost.

As an alternative, a plurality of feed rollers or feed roller segments arranged transversely to the transport direction could also be provided, wherein a plurality of metering devices is nevertheless assigned to each feed roller of the plurality of feed rollers or feed roller segments. By this alone, the number of bearing points and drives can be reduced in comparison to embodiments with an individual feed roller for each strand of starting material.

The plurality of strands is fed to the feed roller in a feed direction, preferably by the metering device. The feed direction can extend radially or tangentially with respect to the feed roller, or it can be oriented at any desired angle to the surface of the feed roller. A certain retaining effect on the strand can be obtained when the feed direction is oriented radially to the feed roller and the strand is deflected by approximately 90° upon arrival at the feed roller.

It is especially preferred that each metering device of the plurality of metering devices comprise a metering element, which can be moved between a first position and a second position. The metering element, when in the first position, is configured to allow the feed of the at least one strand of starting material to the feed roller. In the first position, the strand of starting material is guided through the metering device along a feed path. In the second position, the metering element is configured to inhibit or to stop the feed of the at least one strand of starting material to the feed roller. As a result, the metering device has an especially simple configuration and can be easily integrated into the feed device. Both when in the first and in the second position, the metering element is preferably stationary and fixed; that is, it does not move.

In the first position, the metering element is preferably arranged in such a way that it offers substantially no hindrance to the drawing-in, by the feed roller, of the at least one strand of starting material into the feed roller. For example, the metering element is configured in such a way that, when it is in the first position, it feeds the at least one strand of starting material in a feed direction. The metering element offers the least possible resistance, preferably no resistance at all, to the strand of starting material in question.

When it is in the second position, the metering element is arranged in such a way that the drawing-in, by the feed roller, of the at least one strand of starting material to the feed roller is inhibited; that is, it can be slowed down or even stopped; or possibly it simply does not guide the strand into the engagement area of the feed roller. If the feed of the strand is brought to a stop or if the strand is not supplied to the engagement area of the feed roller, it is impossible for any more starting material to be supplied to the feed roller.

The metering element can be pivotable between the first and second positions, or it can be moved in linear fashion. The metering element can also execute a combination of rotary and linear movements by the use of an appropriate mechanism.

The inhibition or stopping of the feed of the at least one strand of starting material by the metering element proceeds substantially without any change in the rotational speed of the feed roller, which means that the other strands of the plurality of strands arranged adjacent to each other in the axial direction of the feed roller continue to be supplied to the feed roller and drawn in by it.

So that the feed of a strand of starting material can be adjusted with the greatest possible precision, the metering element can be moved into any desired intermediate position between the first and second positions. It is especially preferred that the metering element be adjustable continuously between the first and second positions. As a result, the at least one strand of starting material can not only be supplied without any hindrance or completely stopped but also slowed down to any desired degree.

As a result, it is thus possible, first, to change the amount of starting material supplied as a function of time or per rotation of the feed roller. Second, it is possible to stretch the strand of starting material. This can be achieved in that the feed roller draws in the strand more quickly than the metering device allows.

In a preferred embodiment, the metering element is configured as a clamping element, which, when in the second position, is configured to engage with the at least one strand of starting material at a point upstream of the feed roller relative to the feed direction in order to inhibit or to stop the feed of the at least one strand of starting material to the feed roller. When the metering element is in the first position, the strand of starting material preferably moves through the metering device along a feed path. In the second position, the metering element is arranged at least partially in the feed path of the strand. The metering device preferably comprises a corresponding companion piece, which lies opposite the clamping element relative to the feed path of the strand of starting material. In the second position, the metering element cooperates with the companion piece, so that the strand of starting material is at least partially clamped between the clamping element and the companion piece and is thus slowed down or clamped in a fixed position. The companion piece is preferably configured in such a way that it offers the strand of starting material the least possible resistance when the metering element is in the first position, preferably no resistance at all. The companion piece can be configured as a part of the metering element, as a part of the metering device, or as a part of the feed device. The companion piece is either stationary or, like the metering element, movable between a first position and a second position.

As a result of the movement of the metering element between the first and the second position, the distance between the metering element and the companion piece is progressively reduced, as a result of which the starting-material strand in question can be decelerated to any desired degree. The strand of starting material can also be completely clamped in place between the clamping element and the companion piece, so that it is impossible for any more of the more starting-material strand to be delivered.

In an alternative embodiment, the metering element is configured as a trough, which, when in the first position, is configured to guide the at least one strand of starting material to an engagement area of the feed roller, and, when in the second position, not to guide the at least one strand of the starting material to the engagement area of the feed roller and thus to inhibit or to stop the feed of starting material. The trough can be configured as a pedal trough, for example.

The engagement area of the feed roller is defined as the area in which the feed roller can grip the supplied strand of starting material. This is substantially the area which can be reached by the set of teeth of the feed roller. If the feed roller does not have teeth but is rubberized instead, for example, the engagement area is correspondingly smaller in the radial direction of the feed roller. Because of the air currents within the feed device resulting from the high rotational speeds of the rollers and from possible vibrations of the strand of starting material, the engagement area can also turn out to be somewhat larger.

So that the starting material can be guided along the feed roller to the opening roller, a guide surface of the trough facing the feed roller is configured to the circumferential surface or to the radius of the feed roller and is preferably configured to be complementary to that surface or to that radius.

In the first position, the trough is arranged at a first distance from the feed roller and guides the at least one strand of starting material to the engagement area of the feed roller and along a portion of the circumference of the feed roller in this area. In the second position, the trough is arranged at a second distance from the feed roller such that it does not guide the at least one strand of starting material into the engagement area of the feed roller. The second distance is greater than the first distance. The controlling feature is in particular the distance between the guide surface of the trough and the circumferential surface of the feed roller.

As a result of this arrangement, no active resistance is offered to the strand of starting material. Instead, it is the way in which the strand of starting material is guided which reliably prevents any more starting material from being drawn in by the feed roller.

It is especially preferred that the metering element be configured as a combination of a clamping element and a trough according to the preceding description.

In another embodiment, the metering element therefore comprises a first section and a second section. The first section is now configured as a clamping element, which, when in the second position, is configured to engage with the at least one strand of starting material at a point upstream from the feed roller relative to the feed direction in order to inhibit or to stop the feed of the at least one strand of starting material. The second section is configured as a trough, which, when in the first position, is configured to guide the at least one strand of starting material into an engagement area of the feed roller and, when in the second position, not to guide the at least one strand of starting material into the engagement area of the feed roller and thus to inhibit or to stop the feed of starting material.

This guarantees that, when the metering element is in the second position, the at least one strand of starting material is reliably not drawn in any farther, because it is no longer being guided into the engagement area of the feed roller. On the other hand, it is guaranteed that, while the strand of starting material is not being drawn in any farther, it will not pulled out of the feed device opposite the feed direction, because it is reliably clamped by the first section.

The first and second sections of the metering element can be integrated with each other, so that they form a single metering element. For example, the metering element can be pivotably supported in the feed device, wherein a first section of the metering element facing away from the feed roller is configured as a clamping element, whereas a second section of the metering element facing the feed roller is configured as a trough. The metering element is to be laid out in such a way that a pivoting of the element around the pivot axis into the second position has the effect that the first section moves into the path along which the strand of starting material is traveling, and at least part of the second section is moved away from the area of the feed roller.

The first and second sections of the metering element, however, can also be formed by two separate components, for example, which are preferably connected to each other in an articulated manner. This makes it easy to adapt the metering element to the actual conditions in the feed device and to set up the movements or actions of the first and second sections individually.

It is also preferred that each metering device of the plurality of metering devices comprise an actuating device for moving the associated metering element between the first position and the second position. As a result, the plurality of metering devices can be individually actuated in an especially simple manner.

Each actuating device preferably comprises its own drive, preferably a hydraulic or pneumatic cylinder or a spindle drive. As a result, it is possible to use readily available, low-cost components.

A fleece-forming machine for forming or profiling a material web comprises, according to the invention, a transport device for conveying the material web in a transport direction and at least one feed device according to the preceding description for feeding opened fibers to the transport device.

Thus the advantages described for the feed device above can be exploited in any way desired for the fleece-forming process. As previously described, the fleece-forming machine can be used to form a new material web, to provide an already existing material web with a surface profile in the transverse direction and/or in the longitudinal direction, or to compensate for defective areas in an already existing material web for the purpose of forming a material web with the greatest possible uniformity.

In one embodiment, the fleece-forming machine can comprise two or more feed devices, which are arranged on behind the other in the transport direction of the transport device. The fibers supplied by one feed device can be different from the fibers supplied by the at least one other feed device with respect to at least one property of the fibers. The at least one property of the fibers by which the fibers differ is preferably selected from: the color of the fibers, the type of fiber, the material of the fibers, the diameter of the fibers, the length of the fibers, the treatment of the fibers, the cross-sectional shape of the fibers, and the roughness or the crimping of the fibers. Natural or synthetic fibers, for example, represent different types of fibers. Different fiber materials can be, for example, different natural fibers or different synthetic fibers. With respect to the fiber treatment, chemical treatments of the fibers can be provided, for example. The properties of the fibers then have corresponding effects on the properties of the material web formed from them, so that the mechanical properties or a patterning of the material web can be effectively influenced. It is also possible, however, for all of the feed devices to supply fibers of the same starting material.

According to an aspect of the invention, a method for forming or profiling a material web by a feed device comprising a feed roller and an opening roller which cooperates with the feed roller comprises the following steps: (a) feeding a plurality of strands of a starting material consisting of fibers to the feed roller, wherein the strands are arranged next to each other in an axial direction of the feed roller; (b) drawing in, by the feed roller, the plurality of strands of starting material supplied to it, and conveying them to the opening roller; (c) opening the drawn-in plurality of strands of starting material by the opening roller to form individualized fibers; (d) distributing the individualized fibers onto a transport device to form or to profile the material web; and (e) regulating the feed, relative to each other, of at least a first strand of the plurality of strands of starting material being supplied to the feed roller relative to at least a second strand of the plurality of strands of starting material.

In this way, the feed of a strand of starting material and thus the quantity of fibers produced from it and distributed onto the transport device can be regulated without the need to provide feed rollers which must be individually supported and individually actuated for this purpose. Instead, a plurality of strands can be drawn in by the same feed roller, wherein the possibility of distributing different quantities of fibers transversely to the transport direction and/or in the transport direction, i.e., in the longitudinal and/or transverse direction, remains available. As a result, bearing sites for feed rollers between the adjacent strands of starting material are eliminated, so that the fibers are distributed more uniformly onto the transport device and/or a higher degree of resolution of the distribution of the fibers onto the transport device is achieved. The reduction in the number of bearing sites and in the number of individually actuatable feed rollers and their corresponding drives can also reduce costs significantly.

By regulating the feed of at least one first and one second strand of starting material to the feed roller, the quantity of fibers produced from these strands and distributed onto the transport device can be varied in any way desired. Thus a profile of distributed fibers extending across the width of the transport device can be produced in the transverse direction and/or in the longitudinal direction, or alternatively the most uniform possible material web can be formed by patching defective areas or by correcting variations in the amount of material.

The method is preferably carried out by a previously described feed device. All of the features and advantages described with respect to the feed device and the method steps executed by the feed device can thus be carried over by analogy to the method.

It is especially preferred that the regulation of the feed comprise the changing of the amount of starting material supplied per unit time, per rotation of the feed roller, or per unit length of the starting material consisting of at least one first and one second strand.

It is also preferred that the step of regulating the feed comprises allowing a substantially unhindered feed of at least one strand, i.e., either the first or second strand, or engaging with at least one strand, i.e., either the first or second strand, at a point upstream from the feed roller with respect to the feed direction in order to inhibit or to stop any further feed.

The engagement with at least one strand, i.e., either the first strand or the second strand, can comprise slowing-down the strand in question to any desired degree or even the complete stopping of the strand. Thus it is possible to meter the feed of starting material with a very high degree of precision. For example, the strand in question can be clamped with a greater or lesser degree of force in the feed device upstream from the feed roller. It is especially preferred that the strand in question be clamped reliably between two components when no further feed is to be allowed. This guarantees simultaneously that the strand is held in the feed device, even if it is not being drawn in any farther, and that the strand cannot be pulled out of the feed device. The engagement with at least one strand, i.e., the first strand or the second strand, is achieved by a metering device of the feed device.

In addition or as an alternative, the step of regulating the feed can also comprise guiding at least one strand, i.e., the first or second strand, into an engagement area of the feed roller to allow the further infeed, or guiding at least one strand, i.e., the first or second strand, out of the engagement area of the feed roller in order to inhibit or to stop further infeed. By guiding the strand in question out of the engagement area of the feed roller, the further infeed of the strand in question is prevented with a high degree of reliability. In addition, it is guaranteed that the feed roller can draw the strand in again every easily, as soon as this strand is guided back into the engagement area of the feed roller.

Finally, it is preferred that, during the step of regulating, the feed roller rotates at a constant speed. As a result, it is possible that only the supplied quantity of the strand of starting material being regulated changes, whereas the other strands supplied to the same feed roller continue to be drawn in without change. The quantity of fibers distributed onto the transport device can thus be varied locally in the transverse direction and thus across the width of the material web without changing the rotational speed of the feed roller.

DETAILED DESCRIPTION OF SPECIFIC EMBODIMENTS

Figure 1:
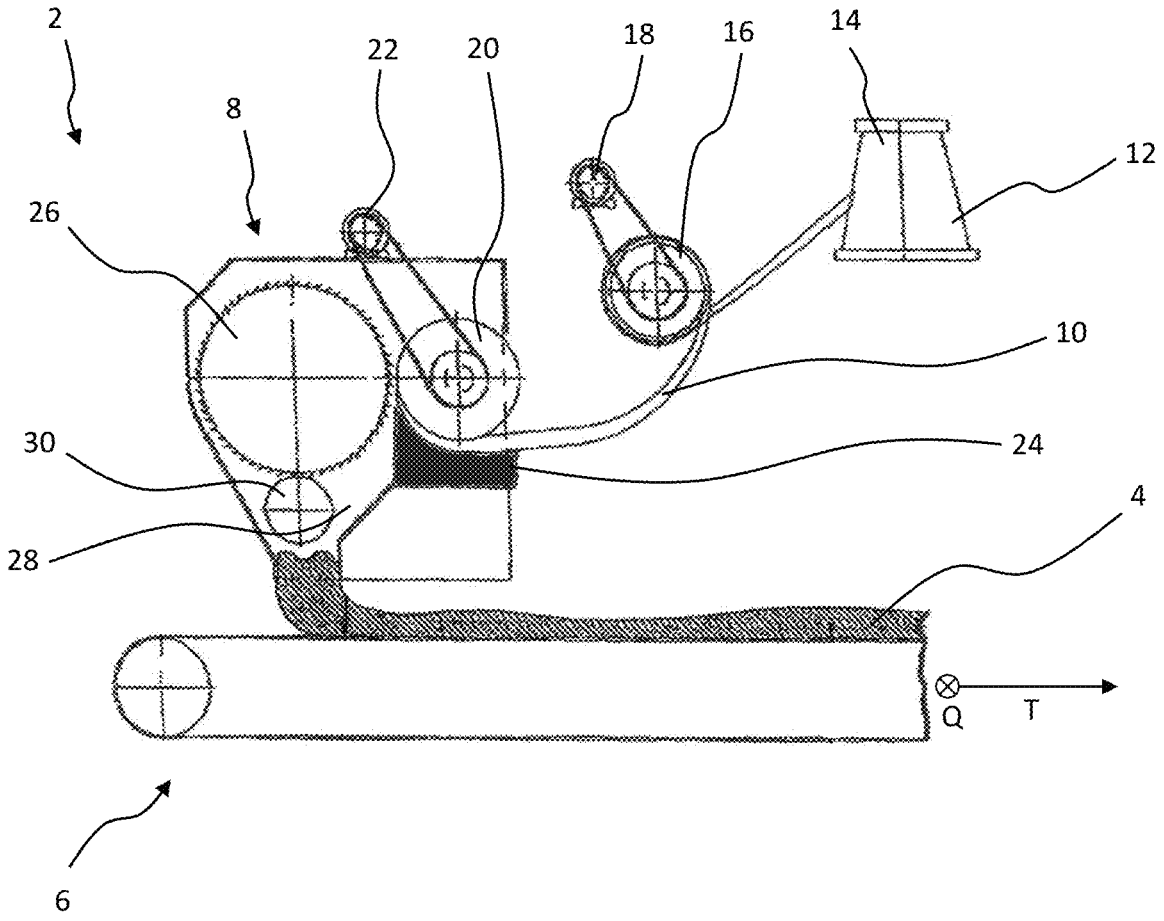
FIG. 1 is a schematic side view of a fleece-forming machine.

FIG. 1 is a schematic side view of a fleece-forming machine 2. Fleece-forming machine 2 is configured to form a material web 4, in particular a card web or a fleece web. Fleece-forming machine 2 comprises a transport device 6 for conveying material web 4 in a transport direction T and at least one feed device 8 for delivering individualized fibers or flocks to transport device 6. In the embodiment shown, feed device 8 forms a new material web 4. In an alternative embodiment, a material web 4, e.g., any desired intermediate fleece product, can already be arranged on transport device 6 upstream of feed device 8 relative to the transport direction T, and fleece-forming machine 2 then distributes additional fibers or flocks onto this material web to form a uniform material web 4 or a material web 4 with a desired surface profile.

Transport device 6 preferably moves continuously in the transport direction T. Transport device 6 can be configured as an endless conveyor belt, preferably as a sieve belt with bottom suction. The speed of transport device 6 is preferably in the range between 0.2 and 20 m/min, more preferably in the range between 0.05 and 10 m/min.

One or more measuring devices (not shown), which measure the weight per unit area of material web 4 across its width extending in the transverse direction Q, can be provided upstream and/or downstream from feed device 8 in the manner familiar to the skilled person. The transverse direction Q is transverse to transport direction T; in FIG. 1, it is perpendicular to the plane of the drawing. The transverse profile can be determined on the basis of the information provided by these measuring devices; and, on the basis of the movement of transport device 6 in transport direction T, the longitudinal profile of material web 4 can also be determined.

The formed material web 4 can be sent by transport device 6 to various alternative processing steps. In a first alternative, material web 4 is sent to card-forming device, preferably a carding machine, and is leveled out there. In a second alternative, the material web is sent directly to a fleece former, e.g., an aerodynamic fleece former. In a third variant, the material web is opened again before further processing. In a fourth alternative, the material web is sent directly to a solidification machine e.g., a needling machine.

Fleece-forming machine 2 also comprises a plurality of dispensing devices 12, each of which stores and dispenses a strand 10 of a starting material 14 consisting of fibers, e.g., a fiber sliver or a fleece strip. Dispensing devices 12 are arranged adjacent to each other in the transverse direction Q, i.e., transversely to transport direction T, and parallel to a support plane of transport device 6 and thus perpendicular to the plane of the drawing in FIG. 1, for which reason only one dispensing device 12 can be seen in FIG. 1. In the exemplary embodiment shown, dispensing device 12 is configured as a spool, but it could also be provided in the form of a sliver can or the like.

The starting material 14 travels from dispensing device 12 to a preferably rubberized storage roller 16, which extends transversely to transport direction T and horizontally over preferably the entire width of feed device 8. One turn of a strand 10 of starting material 14 provided by dispensing device 12 is wrapped around storage roller 16. Storage roller 16 is driven, preferably by a servo motor 18 and also preferably continuously at a relatively slow speed. In certain embodiments, storage roller 16 could also be omitted.

Storage roller 16 can be configured as a one-piece unit. Storage roller 16 can also simultaneously accept several strands 10 of starting material 14 adjacent to each other.

Fleece-forming machine 2 also comprises a rotating, preferably toothed, feed roller 20, to which strands 10 of starting material 14 are delivered. The feed roller 20 draws a plurality of strands 10 of starting material 14 adjacent to each other in an axial direction of feed roller 20 into feed device 8. In the embodiment shown, feed roller 20 draws starting material 14 provided by the associated dispensing devices 12 either by the use of an intermediate storage roller 16 or directly. Feed roller 20 is preferably driven by a servo motor 22. Feed roller 20 is preferably configured as one-piece unit and extends in transverse direction Q over the entire width of feed device 8, preferably at least over the entire width of material web 4 to be formed. Feed roller 20 can, however, also comprise individual segments, which are preferably arranged axially adjacent to each other in transverse direction Q.

The starting material 14 carried along by feed roller 20 is preferably sent via a trough 24 to a toothed opening roller 26. Opening roller 26 can also be configured as a one-piece unit and extend transversely to transport direction T over the entire width of feed device 8, preferably over the entire width of material web 4 to be formed. Opening roller 26, however, could also comprise individual segments, which are axially adjacent to each other and oriented in transverse direction Q.

Opening roller 26 can be driven in the same rotational direction as feed roller 20. Opening roller 26 also comprises a set of projecting teeth. For example, each feed roller 20 comprises a set of teeth which project backwards with respect to the rotational direction of the associated feed roller 20, and opening roller 26 comprises a set of teeth projecting forwards with respect to the rotational direction of opening roller 26. The sets of teeth of feed roller 20 and of opening roller 26, however, can also be configured in some other conventional manner.

Opening roller 26 cooperates with feed roller 20 to open starting material 14. In particular, opening roller 26 and feed roller 20 are especially effective at opening up twisted or compacted starting material 14 of a strand 10, e.g., a fiber sliver or a fiber fleece strip, so that loose flocks or even fine fibers are separated. These drop into an appropriate discharge shaft 28 and fall from there onto transport device 6. In addition, an optional cleaning roller 30 can be provided, which strips off the fibers or flocks adhering to opening roller 26 from the roller, so that these, too, can drop into discharge shaft 28.

Each of FIGS. 2-7 shows a feed device 8 according to the invention with a plurality of metering device 32, which are assigned to an associated feed roller 20. Feed device 8 shown here can constitute part of a fleece-forming machine 2 such as that described with reference to FIG. 1. Correspondingly, all of the features of fleece-forming machine 2 according to FIG. 1 can be carried over to the embodiments according to FIGS. 2-7, which differ substantially only with respect to the embodiment of metering device 32 in question and its arrangement with respect to opening roller 26.

Of the plurality of metering devices 32, only one metering device 32 can be seen in each of the side views of FIGS. 2-7. The other metering devices 32 of the plurality of metering devices 32 are arranged adjacent to the illustrated metering device 32 in a row extending in the axial direction of associated feed roller 20.

In general, each metering device 32 of the plurality of metering devices 32 is configured to regulate the feed of at least one strand 10 of starting material 14 to feed roller 20. This means that each metering device 32 is configured to change the quantity of starting material 14 being delivered and opened by the cooperation between feed roller 20 and opening roller 26 without the need to change the rotational speed of feed roller 20. Each metering device 32 can also regulate the feed of a plurality of strands 10 to feed roller 20, these strands being arranged adjacent to each other in the axial direction of feed roller 20, wherein the feed of this plurality or strands 10 can then be regulated jointly.

It is preferred that each metering device 32 of the plurality or metering devices 32 comprise a metering element 34, which is movable between a first position and a second position. Metering element 34, when in the first position, is configured to allow the feed of the at least one strand 10 of starting material 14 to feed roller 20. In the second position, the metering element 34 is configured to inhibit the feed of the at least one strand 10 of starting material 14 to feed roller 20 or to stop that feed. Metering element 34 can also be moved into any desired intermediate position between the first and second positions.

Each metering device 32 can optionally also comprise a second metering element 36 (see FIGS. 2 and 3), which can be moved similarly to first metering element 34 between a first position and a second position. The advantage of providing a second metering element 36 within metering device 32 is that starting material 14 delivered to first metering element 32 can differ from starting material 14 delivered to second metering element 36 with respect to at least one property of the fibers. The at least one property of the fibers of the two starting materials with respect to which the fibers differ is preferably selected from: the color of the fibers, the type of fiber, the material of the fibers, the diameter of the fibers, the length of the fibers, the treatment of the fibers, the cross-sectional shape of the fibers, and the roughness or the crimping of the fibers. Natural or synthetic fibers, for example, represent different types of fibers. Different fiber materials can be, for example, different natural fibers or different synthetic fibers. With respect to the fiber treatment, chemical treatments of the fibers can be provided, for example. The properties of the fibers then have corresponding effects on the properties of material web 4 formed from them. It is also possible, however, to supply all of metering elements 34, 36 with the same starting material 14. Although shown only in FIGS. 2 and 3, the embodiments according to FIGS. 4-7 can also comprise a corresponding second metering element.

In general, it is also conceivable that a plurality of metering devices 32 could be arranged around the circumference of opening roller 26; these additional metering devices are aligned with each other in the circumferential direction, and the same or a different starting material 14 is supplied to each one. It is also possible in this way for different fibers to be deposited in alternation at one point in transverse direction Q of material web 4 or deposited in any desired mixing ratios onto transport device 6.

Figure 2:
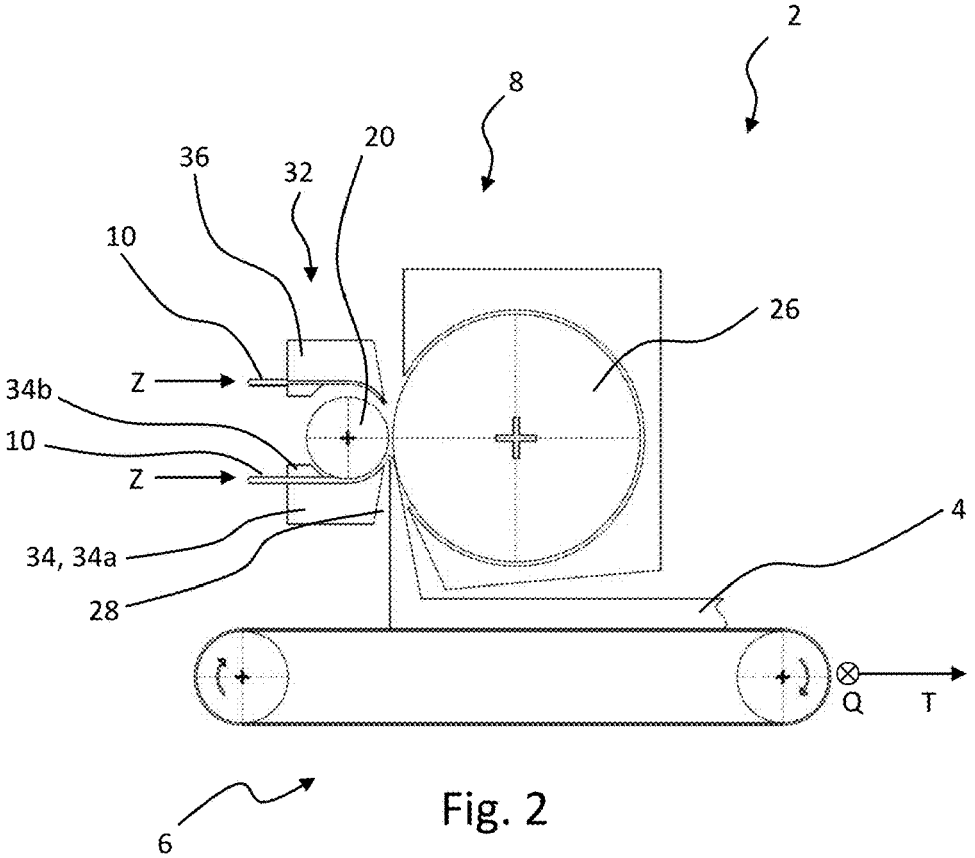
FIG. 2 is a schematic side view of part of a fleece-forming machine with a feed device according to a first embodiment of the invention in a first state.
Figure 3:
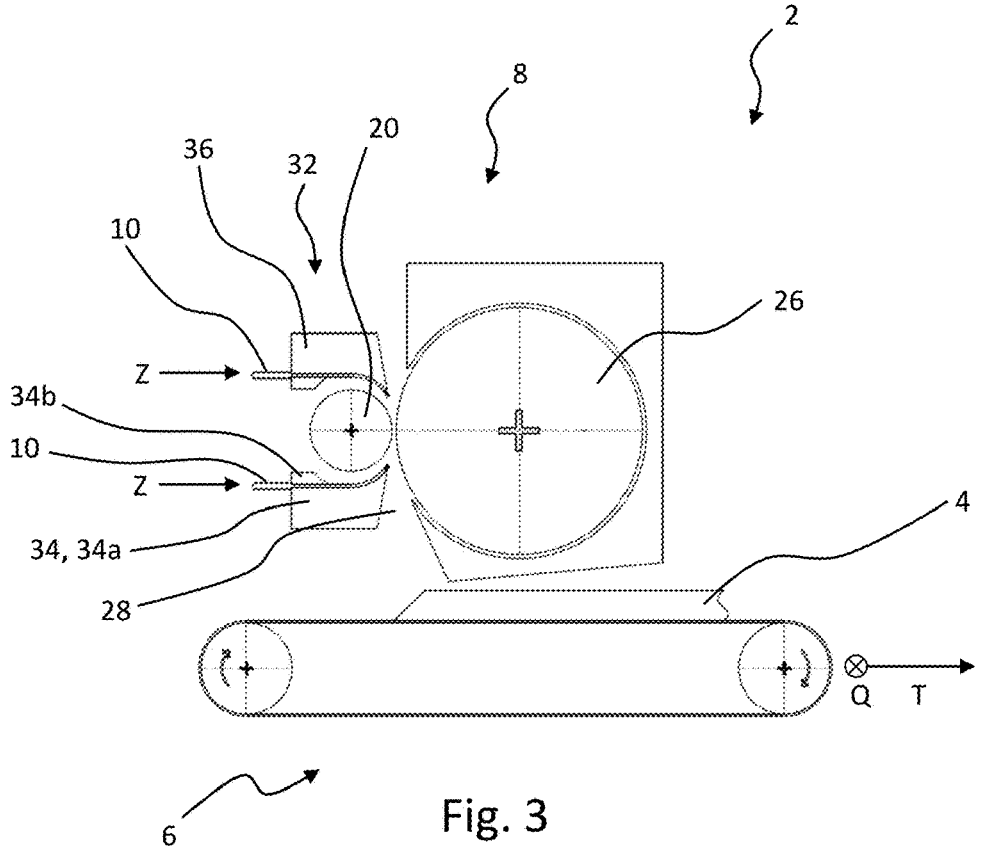
FIG. 3 is a schematic side view of the fleece-forming machine of FIG. 2 with the feed device in a second state.

According to the first embodiment of FIGS. 2 and 3, metering element 34 is configured as a trough. In the embodiment shown here, metering device 32 comprises optional second metering element 36, which is configured in the same way as first metering element 34 and, with respect to its arrangement, is merely shifted to a different position relative to feed roller 20.

FIG. 2 shows first metering element 34 in the first position, in which it allows the delivery of strand 10 of starting material 14 to feed roller 20. For this purpose, metering element 32 guides strand 10 of starting material 14 in a feed direction Z to feed roller 20 and along feed roller 20 to opening roller 26. Metering element 34 is for this purpose configured in the same way as trough 24 described with respect to FIG. 1 and has a shape which is at least partially complementary to the circumferential surface of feed roller 20. Metering element 34 guides strand 10 of starting material 14 into an engagement area of feed roller 20, in which feed roller 20, i.e., its teeth or rubberized surface, can grip strand 10 of starting material 14.

As can also be seen in FIG. 2, strand 10 of starting material 14 supplied to first metering element 34 is opened in an area between feed roller 20 and opening roller 26 by the cooperation of these two rollers, and the opened fibers are deposited through discharge shaft 28 onto transport device 6, where they form material web 4.

In FIG. 2, optional second metering element 36 is arranged in the second position, in which it does not guide the strand 10 of starting material 14 delivered to it into the engagement area of the feed roller. Instead, it holds the strand 10 a certain distance away from the feed roller.

According to FIG. 3, the first metering element 34 is in the second position, in which it does not guide the strand 10 of starting material 14 supplied to it into the engagement area of the feed roller 20 and thus inhibits the delivery of the starting material 14 to the feed roller 20 or stops it completely.

This can be achieved in that the metering element 34, when in the first position, is a certain distance away from the feed roller 20, this distance being smaller than a second distance from the feed roller 20, at which the metering element 34 is arranged when in the second position. The first distance is so small that the set of teeth or the rubberized lateral surface of the feed roller 20 can grip the strand 10 of starting material 14. The second distance, however, is so large that the set of teeth or the rubberized lateral surface of the feed roller 20 are substantially no longer able to engage with the strand 10 of starting material 14. Thus the metering element 34 no longer guides the strand 10 of starting material 14 into the engagement area of the feed roller 20. Although the feed roller 20 continues to rotate, the strand 10 of starting material 14 can no longer be conveyed by it.

The metering element 34 can be shifted in a substantially linear manner between the first position and the second position, or it can be pivoted between the first position and the second position.

To prevent the further infeed of strand 10 of starting material 14 to feed roller 20 even more reliably and to prevent strand 10 from slipping out of feed device 8, strand 10 can also be clamped at a point upstream from feed roller 20 relative to feed direction Z. For example, metering element 34 can for this purpose comprise a first section 34*a* and a second section 34*b*, which are movable relative to each other so that strand 10 becomes clamped between them. One of these sections, i.e., either the first or second section, in particular a section which is stationary, can, however, be formed by feed device 8 or by metering element 32.

Figure 4:
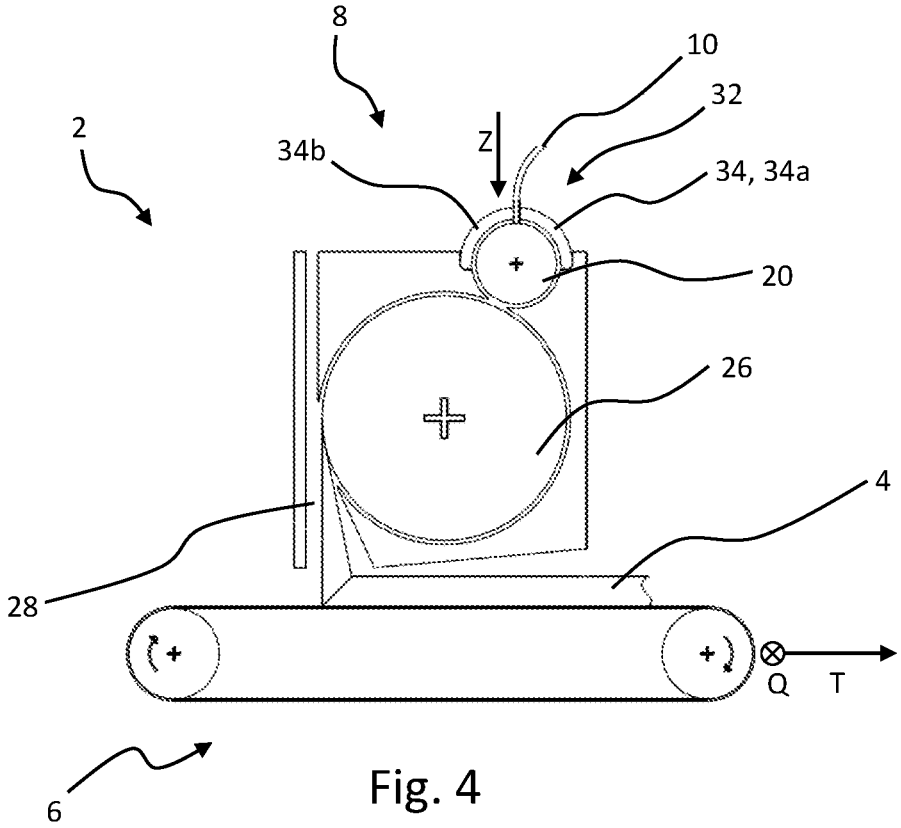
FIG. 4 is a schematic side view of part of a fleece-forming machine with a feed device according to a second embodiment of the invention in a first state.
Figure 5:
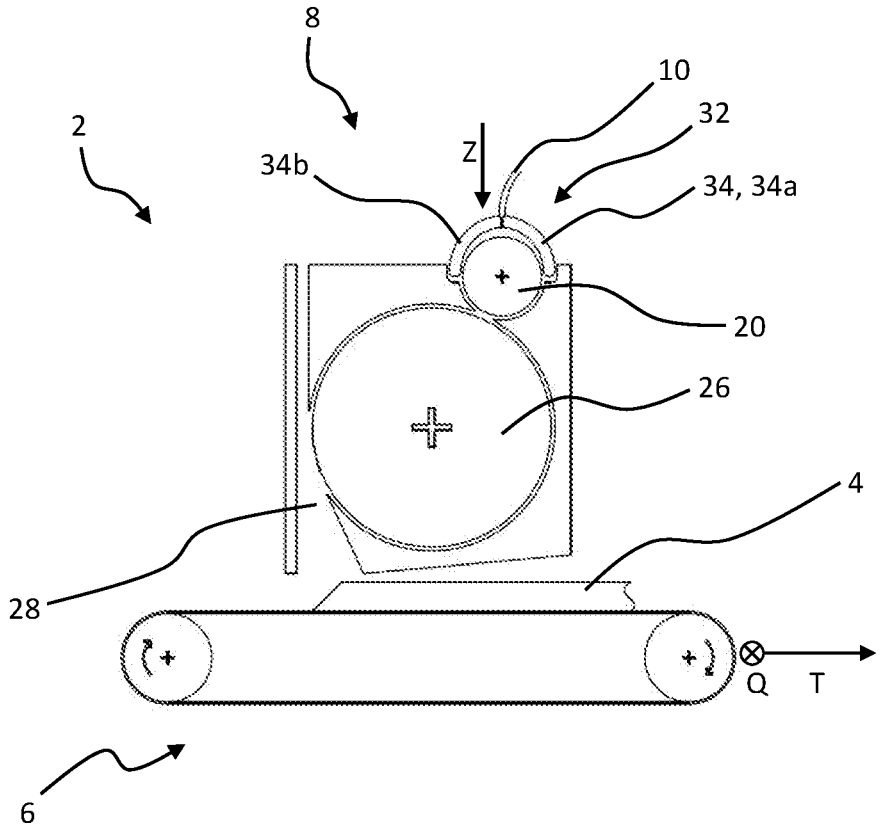
FIG. 5 is a schematic side view of the fleece-forming machine of FIG. 5 with the feed device in a second state.

FIGS. 4 and 5 show a second embodiment of a metering element 32. According to this embodiment, metering element 34 of metering device 32 is configured as a clamping element. Metering element 34 is set up so that, when it is in the second position (FIG. 5), it can engage with the at least one strand 10 of starting material 14 at a location upstream from feed roller 20 relative to feed direction Z in order to inhibit or to stop the delivery of the at least one strand 10 of starting material 14 to feed roller 20.

As can be seen in FIG. 4, when metering element 34 configured as a clamping element is in the first position, it allows starting material 14 to be delivered to feed roller 20 with substantially no hindrance. The cooperation between feed roller 20 and opening roller 26 has the effect of individualizing the fibers of starting material 14 from strand 10, of conveying these fibers along the circumference of opening roller 26 into discharge shaft 28, and of distribution them onto transport device 6 in order to form or to profile material web 4.

According to FIG. 5, metering element 34 is arranged in the second position, in which it inhibits or stops the delivery of strand 10 of starting material 14 to feed roller 20. For this purpose, metering element 34 grips strand 10 of starting material 14. Metering element 34 can be moved into the delivery path of starting material 14, along which strand 10 is guided when metering element 34 is in first position, and press strand 10 against a corresponding companion piece. The companion piece can be part of feed device 8 or part of metering device 32. As illustrated here, however, metering element 34 can also comprise a first section 34*a* and a second section 34*b*, which are movable relative to each other, so that one of these sections 34*a*, 34*b* forms the corresponding companion piece.

If metering element 34 is moved only partially into the delivery path of strand 10, the delivery of strand 10 of starting material is slowed down, so that the amount of starting material 14 arriving at feed roller 20 is reduced. Strand 10 of starting material 14, however, can also be completely clamped by metering element 34, i.e., clamped between metering element 34 and the corresponding companion piece, so that no further delivery of starting material 14 to feed roller 20 is possible. Fibers of the starting material which are located downstream from the clamping point relative to feed direction Z at the time the clamping occurs are combed out by the feed roller 20 and drawn in. Fibers which are clamped by metering element 34 at his time remain in the engagement area of feed roller 20, but they cannot be pulled farther in. When the metering element 34 is opened again and starting material 14 is thus released, these fibers can be gripped by feed roller 20, as a result of which strand 10 of starting material 14 is drawn in again.

As indicated in FIGS. 4 and 5, metering element 34 configured as a clamping element can also, as an option, comprise, when in the second position, a second distance from feed roller 20 which is larger than a first distance of metering element 34 from feed roller 20 when in the first position. When metering element 34 is moved into the first position and is thus closer to feed roller 20 again, the renewed intake of strand 10 of starting material 14 is guaranteed even if these fibers are very short.

Figure 6:
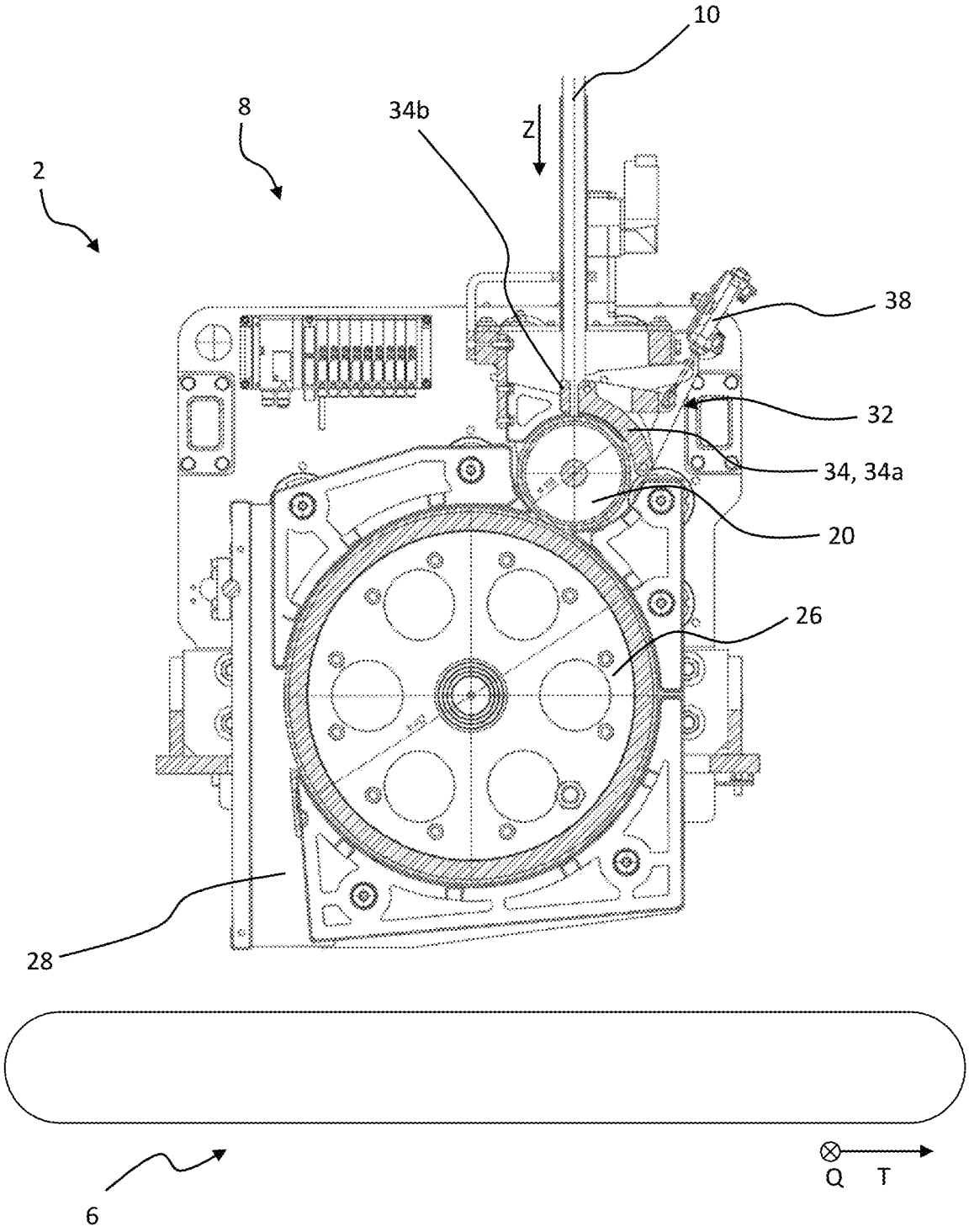
FIG. 6 is a schematic side view of a fleece-forming machine with a feed device according to a third embodiment of the invention in a first state.
Figure 7:
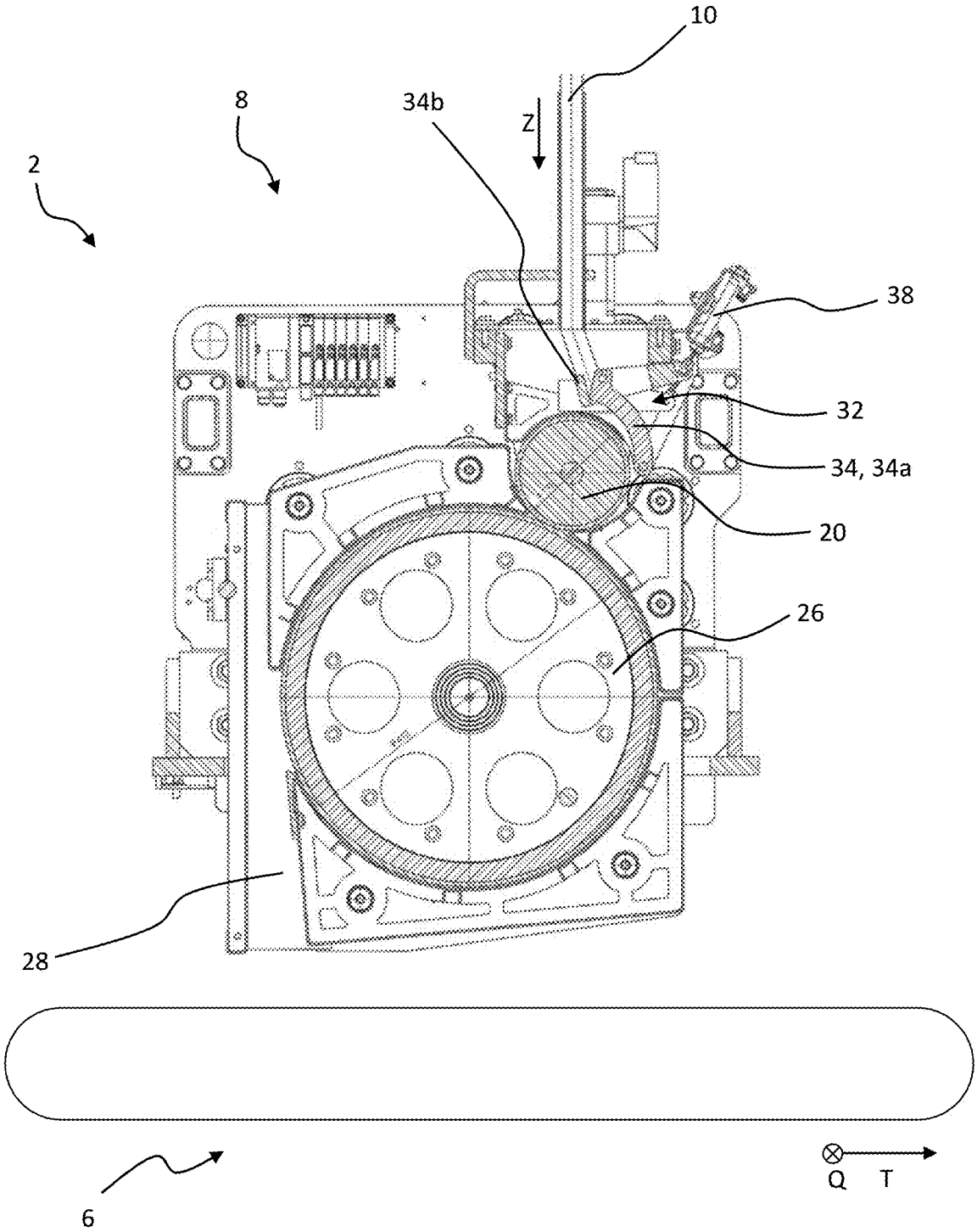
FIG. 7 is a schematic side view of the fleece-forming machine of FIG. 6 with the feed device in a second state.

In the third embodiment according to FIGS. 6 and 7, metering element 34 again comprises a first section 34*a* and a second section 34*b*. First section 34*a* is configured as a trough, which, when in the first position according to FIG. 6, delivers strand 10 of starting material 14 to feed roller 20 and guides starting material 14 into the engagement area of feed roller 20. In area between feed roller 20 and opening roller 26, strand 10 of starting material 14 is opened, and the individualized fibers are conveyed around the circumference of opening roller 26 into discharge shaft 28 and deposited through this shaft onto transport device 6. When metering element 34 is in the first position, second section 34*b* of metering element 34 is arranged in such a way that it allows the delivery of strand 10 of starting material 14 to feed roller 20 with substantially no hindrance.

In the second position according to FIG. 7, first and second sections 34*a*, 34*b* of metering element 34 clamp strand 10 of starting material 14, in that they engage with strand 10 at a location upstream from the feed roller relative to feed direction Z. In the embodiment shown here, first and second sections 34*a*, 34*b* are for this purpose hinged together and are rotated relative to each other into the second position, so that strand 10 is clamped between them. The first section 34*a* of metering element 34 can also be configured in such a way that, when in the second position, it clamps strand 10 of starting material 14 against a corresponding companion piece of feed device 8 or of metering device 32, which means that second section 34*b* does not necessarily have to be present.

At the end facing away from second section 34*b*, first section 34*a* is preferably supported in feed device 8 or metering device 32 in an articulated manner in such a way that the movement of first section 34*a* relative to second section 34*b* into the second position simultaneously has the effect that at least a part of first section 34 moves away from feed roller 20 and ends up at a second, larger distance from feed roller 20.

FIGS. 6 and 7 also show an actuating device 38 for moving metering element 34 between the first position and the second position, this device being similar to that used in the first and second embodiments.

Actuating device 38 comprises a drive such as a hydraulic or pneumatic cylinder, a spindle drive, etc. Actuating device 38 can be connected directly to metering element 34 and move it between the first and second positions in either a linear or rotational manner. Actuating device 38, however, can also be connected to metering element 34 by way of an appropriate mechanism, as a result of which it is possible to combine various types of movements or to realize a movement with several components.

In the embodiment shown here, actuating device 38 is connected to second section 34*b* of metering element 34.

Second section 34*b* is connected in turn in an articulated manner to first section 34*a* of metering element 34. As can be derived from a consideration of FIGS. 6 and 7 together, the actuation of actuating device 38 has the effect of shifting the end of second section 34*b* of the metering element connected to actuating device 38. As a result, first and second sections 34*a*, 34*b* are pivoted relative to each other so that they engage with the strand 10 of starting material 14. In addition, first section 34*a* is pivoted relative to feed roller 20 so that it no longer guides starting material 14 into the engagement area of feed roller 20. Any further delivery of starting material 14 to feed roller 20 is thus reliably prevented. It is also guaranteed that strand 10 of starting material 14 will not be pulled out of feed device 8, because it is clamped at the end by metering element 34.

The embodiments have been described above with a continuous feed roller 20. It is also possible, however, to provide several feed rollers adjacent to each other, each of which draws in a plurality of strands of starting material arranged next to each other in an axial direction of the feed roller.

It is also possible for several feed rollers, each of which draws in a plurality of strands of starting material arranged next to each other in the axial direction of the feed roller, to be arranged in the circumferential direction, spaced a certain distance apart around the circumference of the opening roller. Each of these feed rollers can extend continuously across the width of the opening roller, or at least some of the feed rollers can also be arranged in a line extending along the circumference of the opening roller, or at least some of these feed rollers can also be arranged a certain distance apart in the axial direction of the opening roller.

Any desired combinations of the possibilities described in the preceding two paragraphs are also conceivable.

Finally, it is possible to arrange several feed devices according to the invention in a row, one behind the other, in the transport direction of the material web.

The invention claimed is:

1. A feed device for delivering individualized fibers to a transport device, the feed device comprising:

a feed roller configured to draw in a plurality of strands of a starting material consisting of fibers, the strands being arranged adjacent to each other in an axial direction of the feed roller, into the feed device; and an opening roller, which cooperates with the feed roller to open the strands of starting material;

wherein the feed device comprises a plurality of metering devices assigned to the feed roller, wherein each metering device of the plurality of metering devices is configured to regulate delivery of at least one strand of starting material to the feed roller, wherein each metering device of the plurality of metering devices comprises a metering element, which is actively movable between a first position and a second position;

wherein the metering element, when in the first position, is configured to allow the delivery of the at least one strand of starting material to the feed roller; and wherein the metering element, when in the second position, is configured to inhibit or to stop the delivery of the at least one strand of starting material to the feed roller.

2. The feed device of claim 1 wherein at least one first metering device of the plurality of metering devices is actuatable independently of at least one second metering device of the plurality of metering devices.

3. The feed device of claim 1 wherein the feed roller is configured to extend continuously over the entire working width of the feed device.

4. The feed device of claim 1 wherein the metering element is movable into any desired intermediate position between the first and second positions.

5. The feed device of claim 1 wherein the metering element is configured as a clamping element, which, when in the second position, is configured to engage with the at least one strand of starting material at a location upstream from the feed roller relative to the feed direction in order to inhibit or to stop the delivery of the at least one strand of starting material to the feed roller.

6. The feed device of claim 1 wherein the metering element is configured as a trough, which, when in the first position, is configured to guide the at least one strand of starting material into an engagement area of the feed roller and, when in the second position, not to guide the at least one strand of starting material into the engagement area of the feed roller in order to inhibit or to stop the delivery of the starting material.

7. The feed device of claim 1 wherein the metering element comprises a first and a second section, wherein the first section is configured as a clamping element, which, when in the second position, is configured to engage with the at least one strand of starting material at a location upstream from the feed roller relative to the feed direction thus inhibiting or stopping the delivery of the at least one strand of starting material; and wherein the second section is configured as a trough, which, when in the first position, is configured to guide the at least one strand of starting material into an engagement area of the feed roller and, when the second position, not to guide the at least one strand of starting material into the engagement area of the feed roller in order to inhibit or to stop the delivery of the starting material.

8. The feed device of claim 1 wherein each metering device of the plurality of metering devices comprises an actuating device for moving the associated metering element between the first position and the second position.

9. A fleece-forming machine for forming or profiling a material web, comprising:

a transport device for conveying the material web in a transport direction; and at least one feed device for delivering individualized fibers to the transport device, wherein the at least one feed device comprises:

a feed roller configured to draw in a plurality of strands of a starting material consisting of fibers, the strands being arranged adjacent to each other in an axial direction of the feed roller, into the feed device; and an opening roller, which cooperates with the feed roller to open the strands of starting material;

wherein the feed device comprises a plurality of metering devices assigned to the feed roller, wherein each metering device of the plurality of metering devices is configured to regulate delivery of at least one strand of starting material to the feed rollers;

wherein each metering device of the plurality of metering devices comprises a metering element, which is actively movable between a first position and a second position;

wherein the metering element, when in the first position, is configured to allow the delivery of the at least one strand of starting material to the feed roller; and wherein the metering element, when in the second position, is configured to inhibit or to stop the delivery of the at least one strand of starting material to the feed roller.

* * * * *